US008635830B2

(12) United States Patent
Schold

(10) Patent No.: US 8,635,830 B2
(45) Date of Patent: Jan. 28, 2014

(54) SYSTEMS AND METHODS FOR CONSTRUCTING A BUILDING STRUCTURE

(76) Inventor: John A. Schold, Penngrove, CA (US)

( * ) Notice: Subject to any disclaimer, the term of this patent is extended or adjusted under 35 U.S.C. 154(b) by 0 days.

(21) Appl. No.: 13/049,831

(22) Filed: Mar. 16, 2011

(65) Prior Publication Data

US 2012/0233954 A1 Sep. 20, 2012

(51) Int. Cl.
*E04H 12/00* (2006.01)

(52) U.S. Cl.
USPC ..... 52/650.1; 52/93.1; 52/282.2; 52/655.1; 52/848; 403/217

(58) Field of Classification Search
USPC ..... 52/93.1, 282.1, 282.2, 236.6, 650.1, 52/655.1, 715, 848, 849; 403/217, 171, 403/176
See application file for complete search history.

(56) References Cited

U.S. PATENT DOCUMENTS

| | | | | |
|---|---|---|---|---|
| 674,752 | A | 5/1901 | Baker | |
| 691,049 | A | 1/1902 | D'Espine | |
| 1,000,395 | A | 8/1911 | Frost | |
| 3,166,037 | A | 1/1965 | Otis | |
| 3,603,053 | A | 9/1971 | Van Logheim et al. | |
| 3,788,024 | A | 1/1974 | De Hartog | |
| 3,798,860 | A | 3/1974 | Mason | |
| 4,142,342 | A | 3/1979 | Jungers et al. | |
| 4,409,763 | A | 10/1983 | Rydeen | |
| 4,825,620 | A * | 5/1989 | Johnson | 52/646 |
| 4,863,305 | A * | 9/1989 | Schold | 403/171 |
| 5,600,924 | A | 2/1997 | Forsberg | |
| 5,966,892 | A * | 10/1999 | Platt | 52/712 |
| 6,272,796 | B1 * | 8/2001 | Metzler | 52/93.1 |
| 6,829,872 | B2 * | 12/2004 | Wahlsteen | 52/741.1 |
| 7,661,228 | B1 | 2/2010 | Nolte et al. | |
| 2003/0021625 | A1 | 1/2003 | Mattle | |
| 2006/0137283 | A1 * | 6/2006 | Logan et al. | 52/655.1 |
| 2008/0178551 | A1 | 7/2008 | Porter | |
| 2009/0307999 | A1 | 12/2009 | Nii | |
| 2011/0280649 | A1 * | 11/2011 | Dewson et al. | 403/171 |

FOREIGN PATENT DOCUMENTS

| | | |
|---|---|---|
| GB | 2036235 | 6/1980 |

OTHER PUBLICATIONS

International Search Report and Written Opinion dated Jun. 4, 2012 for PCT Application No. PCT/US12/28836.
International Preliminary Report on Patentability dated Sep. 26, 2013 for PCT Appln. No. PCT/US2012/028836.
Non-Final Office Action dated Sep. 20, 2013 for U.S. Appl. No. 13/956,351.
Corrected Non-Final Office Action dated Nov. 25, 2013 for U.S. Appl. No. 13/956,351.

* cited by examiner

*Primary Examiner* — Brian Glessner
*Assistant Examiner* — Brian D Mattei
(74) *Attorney, Agent, or Firm* — Vista IP Law Group, LLP

(57) ABSTRACT

A system having a beam having a first end, a second end, and a longitudinal axis extending between the first end and the second end, wherein the first end is offset relative to the longitudinal axis in a first direction, and wherein the second end is offset relative to the longitudinal axis in a second direction that is opposite of the first direction.

27 Claims, 10 Drawing Sheets

SYSTEMS AND METHODS FOR CONSTRUCTING A BUILDING STRUCTURE

FIELD

This application relates generally to building systems.

BACKGROUND

Construction of a building structure generally involves a lengthy and complicated process, and requires multiple professionals in different fields to get involved. In existing process, an architect would design the building. Then the architect would provide the architectural plan to engineers (e.g., civil engineers, electrical engineers, mechanical engineers, etc.) to design the various components of the building. When a set of construction plans from the various professionals is completed, the plans are then provided to construction contractors, who then construct the building according to the construction plan. Applicant of the subject application determines that such process may be inefficient and not cost effective.

Also, before or during the construction of the building, if an owner of the building wishes to change the configuration of the building, the above process may need to be repeated, thereby involving multiple professionals, and causing a significant delay in the process.

In addition, after the building is constructed, if the owner wishes to change the configuration of the building, the above process may also need to be repeated, which may also be costly and inefficient. Also, changing the configuration of the building after it is constructed may require removal of some building components in a destructive manner. Thus, the removed components are not and cannot be re-used for later construction. Applicant of the subject application determines that it may be desirable to have a building system that would allow components of a building structure to be selectively removed in a non-destructive manner so that the components may be re-used if desired.

SUMMARY

In accordance with some embodiments, a system having a beam having a first end, a second end, and a longitudinal axis extending between the first end and the second end, wherein the first end is offset relative to the longitudinal axis in a first direction, and wherein the second end is offset relative to the longitudinal axis in a second direction that is opposite of the first direction.

In accordance with other embodiments, a building system includes a connector having a first plate having a first opening for connection to a first beam and a second opening for connection to a first column, and a second plate having a third opening for connection to a second beam and a fourth opening for connection to the first column, wherein the first plate is oriented relative to the second plate at 90°, wherein the first opening at the first plate and the third opening at the second plate are located at a first elevation with respect to the connector, wherein the second opening at the first plate is located at a second elevation with respect to the connector, wherein the fourth opening at the second plate is located at a third elevation with respect to the connector, and wherein the second plate does not include any opening at the second elevation.

Other and further aspects and features will be evident from reading the following detailed description of the embodiments, which are intended to illustrate, not limit, the invention.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only typical embodiments and are not therefore to be considered limiting of its scope.

DESCRIPTION OF THE EMBODIMENTS

Figure 1:
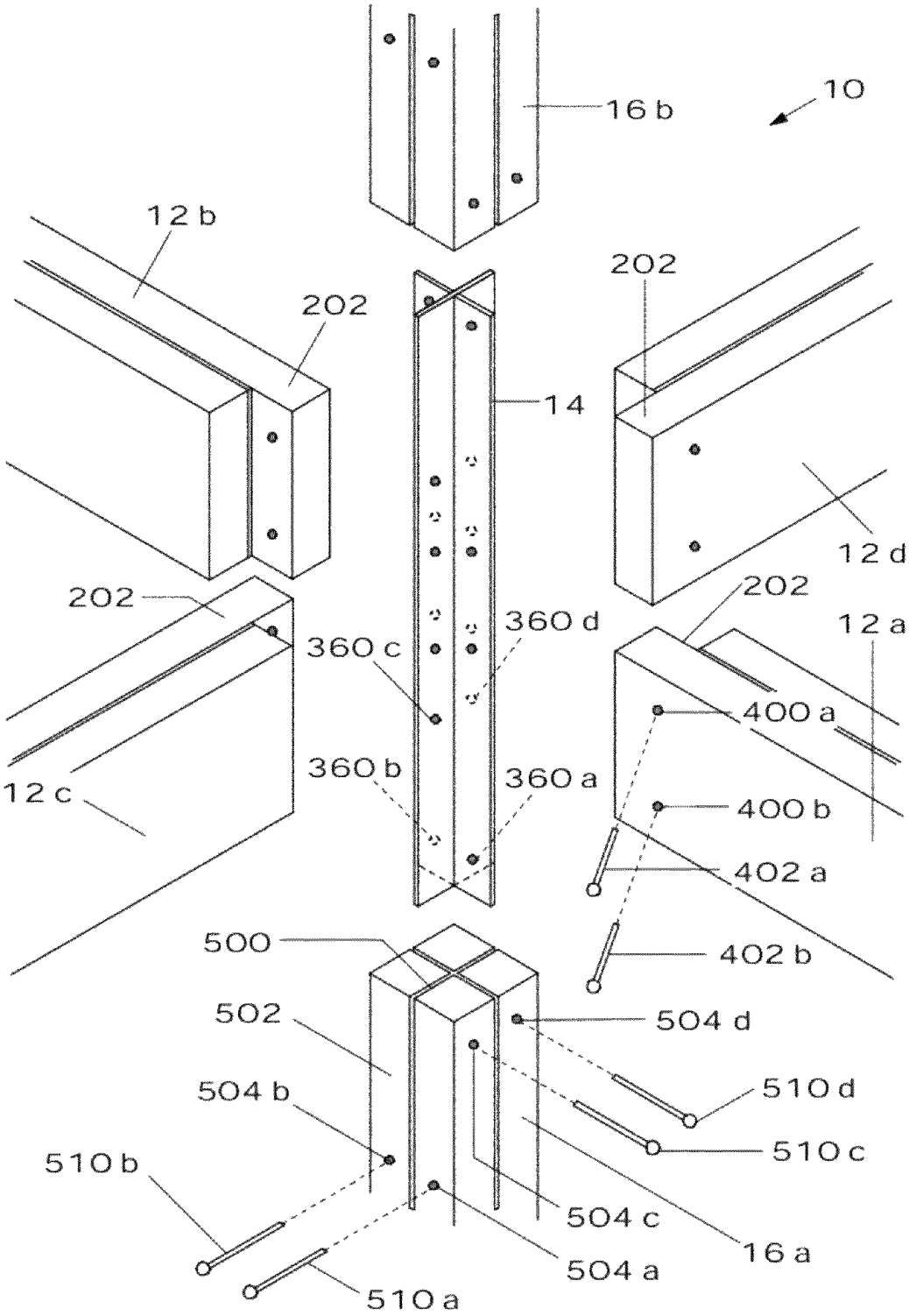
FIG. 1 illustrates a building system in accordance with some embodiments.

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

FIG. 1 illustrates a building system 10 in accordance with some embodiments. The building system 10 includes a first beam 12*a*, a second beam 12*b*, a third beam 12*c*, and a fourth beam 12*d*. The building system 10 also includes a connector 14 to which the beams 12*a*-12*d* are detachably coupled. As shown in the figure, the building system 10 further includes a first column 16*a* and a second column 16*b* that are configured to detachably couple to the connector 14. In other embodiments, the system 10 may include additional beams 12, connectors 14, and columns 16. Also, in other embodiments, the beams 12, connectors 14, and/or columns 16 may come with different sizes (e.g., one column 16 may be longer than another, one beam 12 may be longer and/or deeper than another, etc.).

Figure 2A:
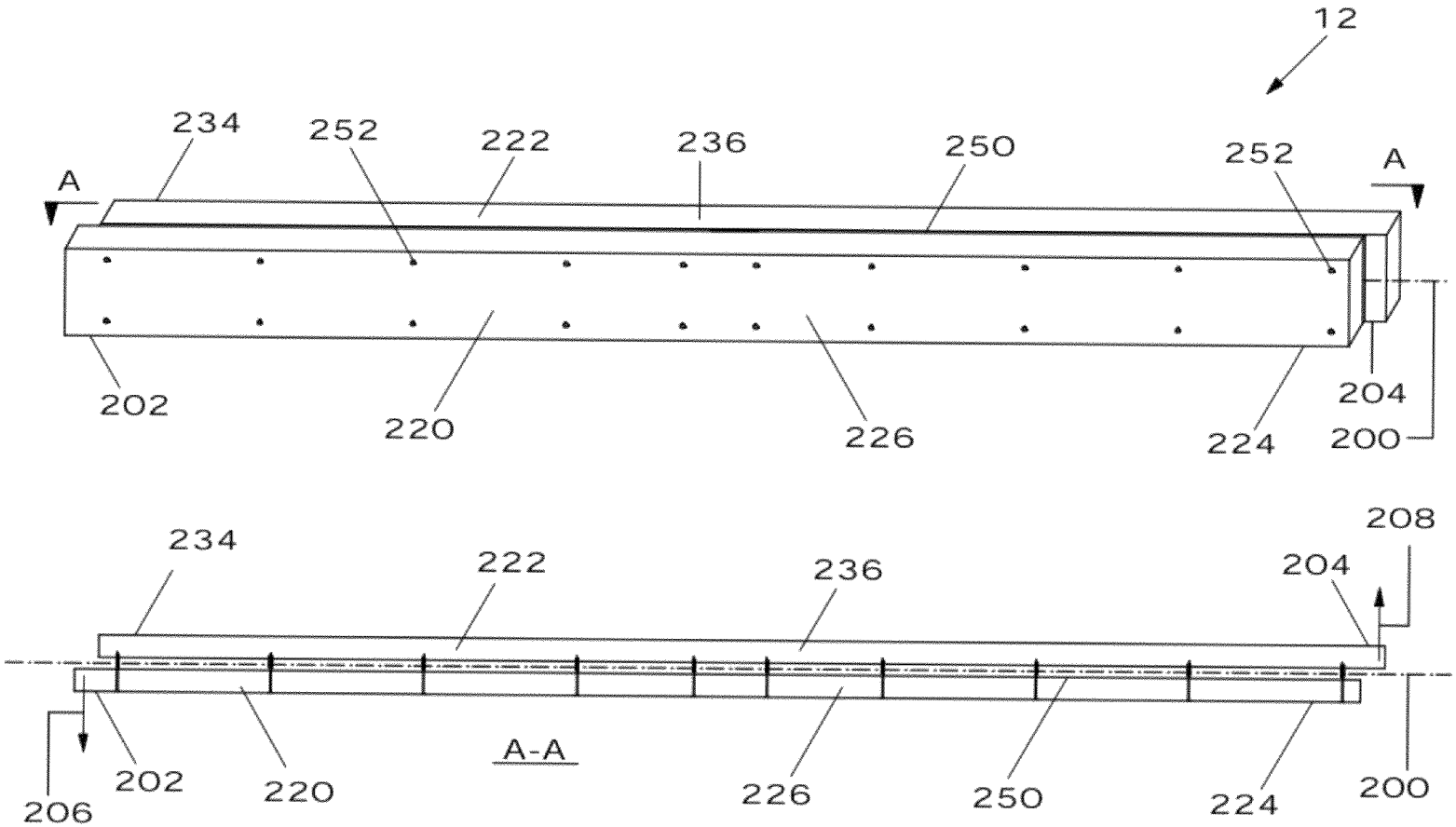
FIG. 2A illustrates an embodiment of a beam in accordance with some embodiments.

FIG. 2A illustrates a beam 12 in accordance with some embodiments. The beam 12 may be any of the beams 12*a*-12*d* in FIG. 1. The beam 12 has a longitudinal axis 200, a first end 202, and a second end 204. The first end 202 is offset from the longitudinal axis 200 in a first direction 206, and the second end 204 is offset from the longitudinal axis 200 in a second direction 208 that is opposite of the first direction 206. In the illustrated embodiments, the beam 12 is formed using a first beam portion 220 and a second beam portion 222. Each of the portions 220, 222 may be a timber member, a steel member, or member made from other types of materials. In other embodiments, each of the portions 220, 222 may be a composite member. Also, instead of having a rectangular cross section shown, in other embodiments, each of the beam portions 220, 222 may have other cross sectional shapes, such as a L-shape, an I-shape, or other shapes.

As shown in the figure, the first beam portion 220 has the first end 202, an opposite end (a first opposite end) 224, and a body 226 extending between the ends 202, 224. Similarly, the second beam portion 222 has the second end 204, an opposite end (a second opposite end) 234, and a body 236 extending between the ends 204, 234. The first beam portion 220 and the second beam portion 222 are offset relative to each other in a direction of the longitudinal axis 200, so that the first end 202 of the first beam portion 220 extends past the second opposite end 234 of the second beam portion 222, and the second end 204 of the second beam portion 222 extends past the first opposite end 224 of the first beam portion 220.

Also, as shown in the illustrated embodiments, the beam 12 includes a plate 250 sandwiched between the first and second beam portions 220, 222. The plate 250 may be a plywood, a metal (e.g., steel, aluminum) plate, or otherwise made from a composite material. In other embodiments, instead of having a plate 250 that extends along the majority of the length of the beam 12, the beam 12 may include a plurality of plates 250 that are placed along the length of the beam 12 to provide various spacing.

In the illustrated embodiments, the first beam portion 220, the plate 250, and the second beam portion 222 are detachably coupled to each other using fasteners 252, which may be screws or bolts. In other embodiments, the first beam portion 220, the plate 250, and the second beam portion 222 may be non-detachably secured to each other (i.e., secured in a relatively more permanent manner so that separation of the components would require at least some destruction to occur), such as by using nails and/or adhesive. Also, in other embodiments, instead of having two rows of fasteners 252, the beam 12 may include one row of fasteners 252, or more than two rows of fasteners 252.

Forming the beam 12 using two beam portions 220, 222 is advantageous because it allows the two beam portions 220, 222 to be individually detached from the rest of the building as one technique of removing the beam 12 from the rest of the building. In another technique, the beam 12 may be removed from the rest of the building without taking apart the two beam portions 220, 222 relative to each other.

Figure 2B:
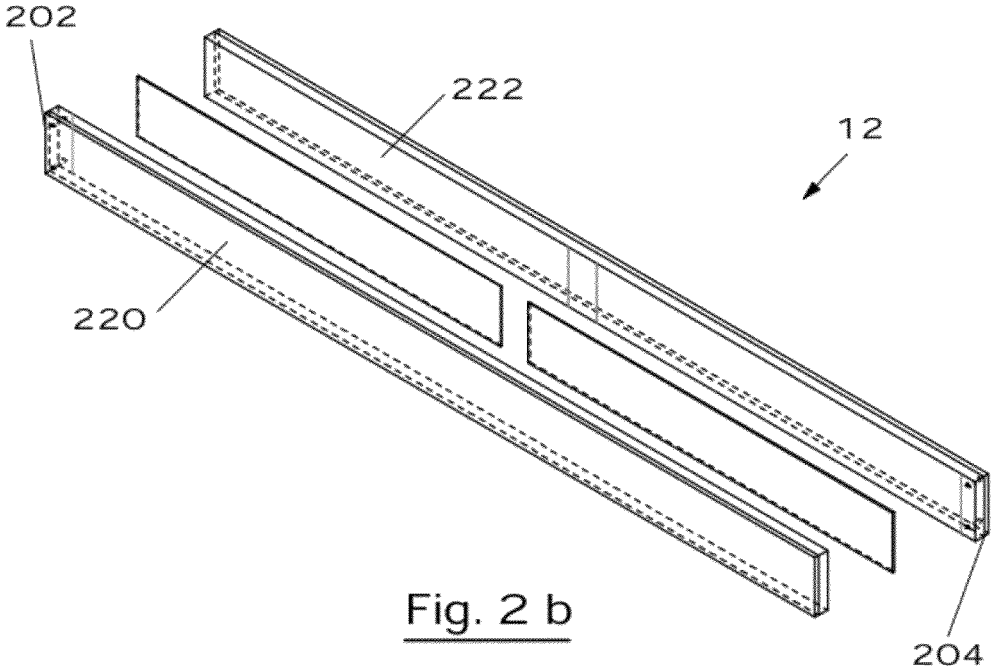
FIG. 2B illustrates an embodiment of a beam in accordance with some embodiments.
Figure 2C:
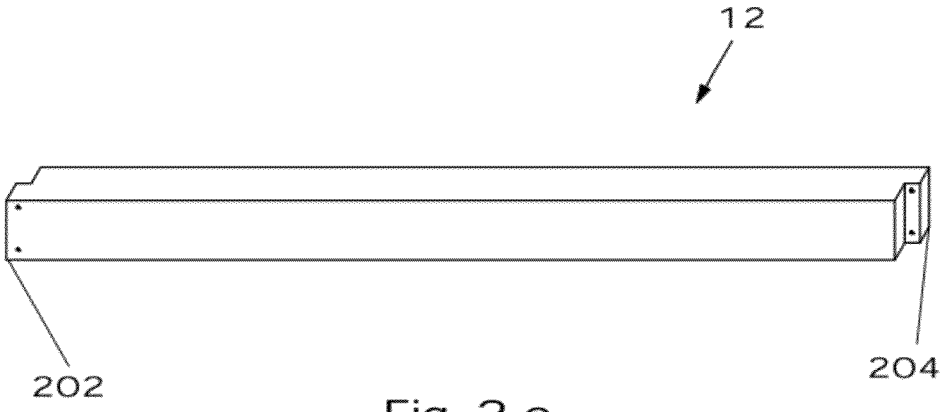
FIG. 2C illustrates an embodiment of a beam in accordance with some embodiments.

In other embodiments, the beam 12 may not include a plate between the two beam portions 220, 222 (FIG. 2B). Instead, the beam portions 220, 222 may be directly secured to each other. Also, in further embodiments, instead of forming the beam 12 using the two beam portions 220, 222, the beam 12 may be formed using a single member with parts of the ends removed to form the offset configuration shown at each of the ends 202, 204 of the beam 12 (FIG. 2C).

Figure 3:
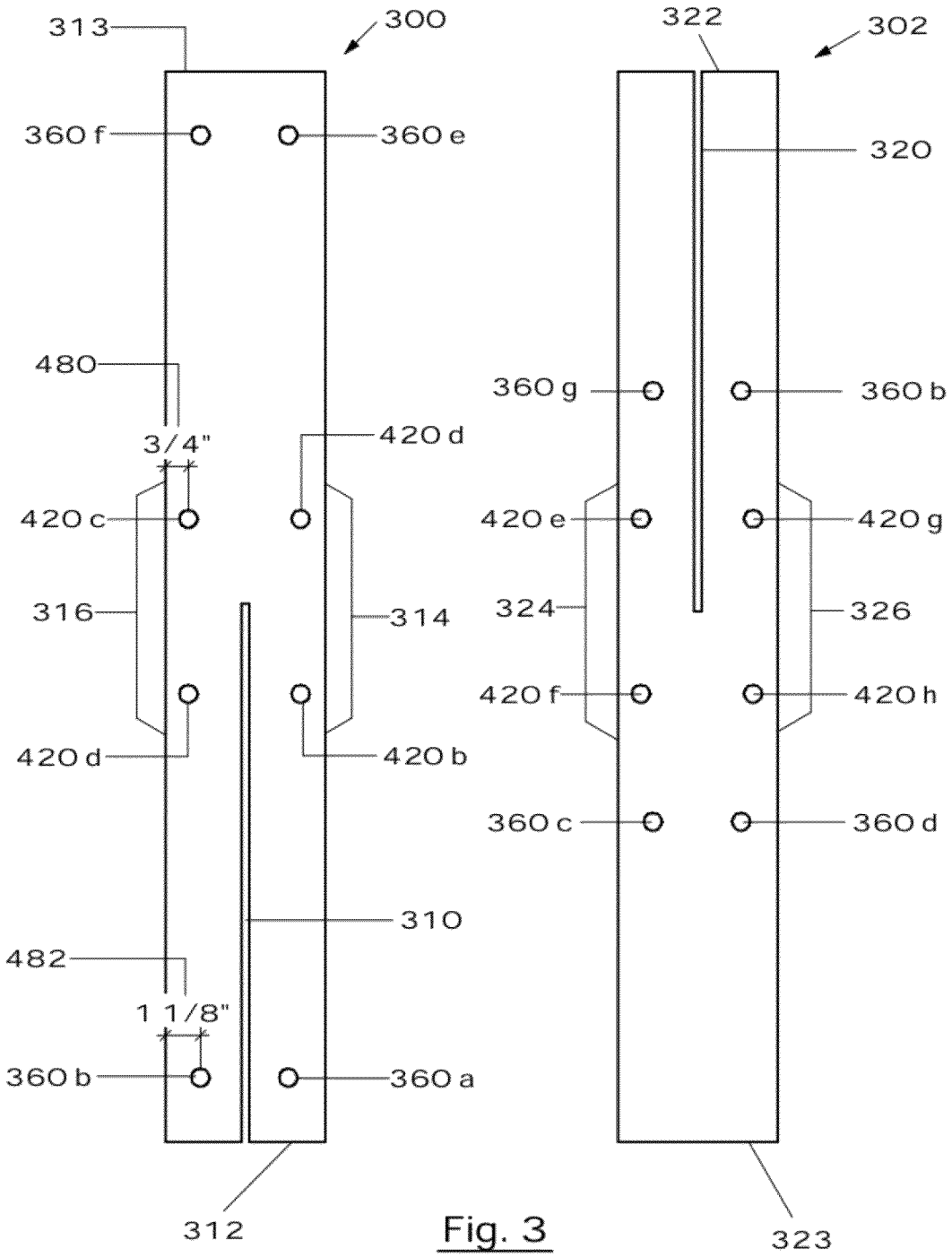
FIG. 3 illustrates components of a connector in accordance with some embodiments.

FIG. 3 illustrates components of the connector 14 of FIG. 1 in accordance with some embodiments. As shown in FIG. 1, the connector 14 has a cross shape cross section. In some embodiments, the connector 14 may be formed from a first plate 300 and a second plate 302 (FIG. 3). The first plate 300 includes a slot 310 extending from a side 312 of the first plate 300, a first plate portion 314 on one side of the slot 310, and a second plate portion 316 on the other side of the slot 310. Similarly, the second plate 302 includes a slot 320 extending from a side 322 of the second plate 322, a first plate portion 324 on one side of the slot 320, and a second plate portion 326 on the other side of the slot 320. In the illustrated embodiments, the first plate 300 and the second plate 302 are secured to each other using the slots 310, 320, and the securing is achieved without using any weld or fasteners.

In other embodiments, the first and second plates 300, 302 may be secured to each other using weld and/or fasteners. Also, in other embodiments, either one or both of the plates 300, 302 may be formed using two plate elements. For example, the first plate 300 and the second plate 302 may not include the slots 310, 320, and the second plate 302 may include two separate plate elements that are secured (e.g., by weld) to opposite surfaces of the first plate 300.

Also, as shown in the figure, the first plate portion 314 at the connector 14 has openings 420*a*, 420*b* configured (e.g., sized and/or shaped) for allowing the first beam 12*a* to be detachably coupled thereto, and the second plate portion 316 has openings 420*c*, 420*d* configured for allowing the second beam 12*b* to be detachably coupled thereto. Similarly, the first plate portion 324 at the connector 14 has openings 420*e*, 420*f* configured for allowing the third beam 12*c* to be detachably coupled thereto, and the second plate portion 326 has openings 420*g*, 420*h* configured for allowing the fourth beam 12*d* to be detachably coupled thereto.

In the illustrated embodiments, the first beam 12*a* is detachably coupled to the first plate portion 314 of the first plate 300, the second beam 12*b* is detachably coupled to the second plate portion 316 of the first plate 300, the third beam 12*c* is detachably coupled to the first plate portion 324 of the second plate 322, and the fourth beam 12*d* is detachably coupled to the second plate portion 326 of the second plate 322. Also, the first column 16*a* is detachably coupled to a bottom of the connector 14, and the second column 16*b* is detachably coupled to a top of the connector 14.

Figure 4:
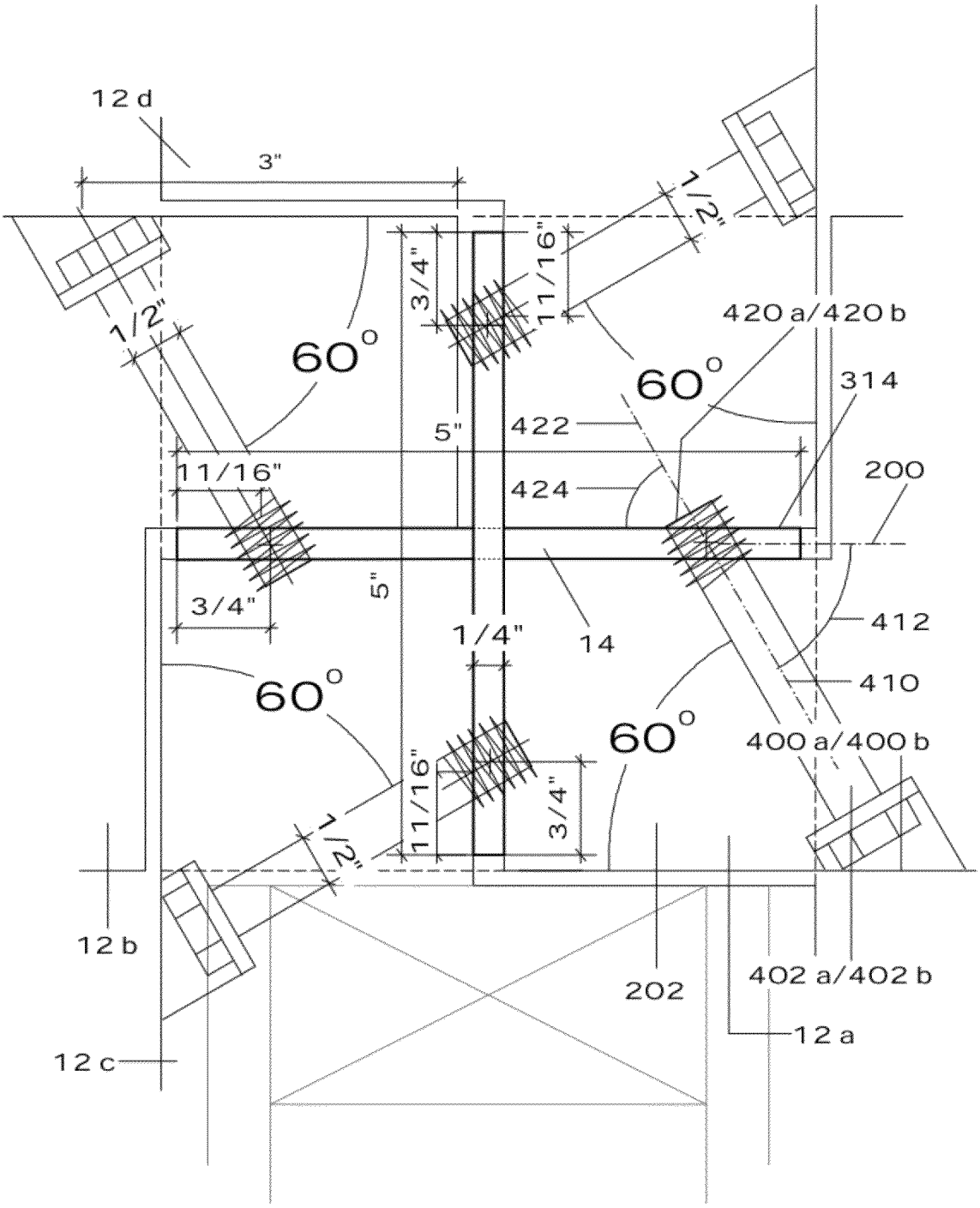
FIG. 4 illustrates a cross sectional view of the connector of FIG. 1 in accordance with some embodiments.

As shown in FIGS. 1 and 4, the first end 202 of the beam 12*a* has two openings 400*a*, 400*b* for accommodating respective fasteners 402*a*, 402*b*. The fasteners 402*a*, 402*b* are for detachably coupling the beam 12*a* to the connector 14. The system 10 also includes additional fasteners 402 (not shown) for detachably coupling the beams 12*c*-12*d* to the connector 14 in a similar manner as that of beam 12*a*. The fasteners 402*a*, 402*b* may be bolts, screws, or other types of connection devices. Each of the openings 400*a*, 400*b* has an axis 410 extending therethrough, wherein the axis 410 forms an acute angle 412 with the longitudinal axis 200 of the beam 12*a*. The acute angle 412 may be any value that is between 30° and 80°, and more preferably between 45° and 75° (such as) 60°). Each of the openings 420*a*, 420*b* at the first plate portion 314 has an axis 422 extending therethrough, wherein the axis 422 forms an acute angle 424 (which has the same value as the acute angle 412) with the first plate portion 314. The other plate portions 316, 324, 326 have openings 324 with similar configuration as that of the openings 324 at the first plate portion 314.

As shown in FIG. 4, the openings 420*a*, 420*b* at the connector 14 correspond with the respective openings 400*a*, 400*b* at the beam 12*a*, so that the fasteners 402*a*, 402*b* can extend through the respective openings 400*a*, 400*b* at the beam 12*a* to reach the respective openings 420*a*, 420*b* at the connector 14. Each fastener 402 may have threads at the distal end for mating with threads at the opening 420 at any of the plate portions 314, 316, 324, 326. The skewed openings 420*a*, 420*b* at the connector 14 and the skewed openings 400*a*, 400*b* at the beam 12*a* allows the fasteners 402*a*, 402*b* to be installed at an acute angle. Such configuration is advantageous because when all four beams 12*a*-12*d* are installed, their respective fasteners are exposed and are accessible so that any of the beams 12*a*-12*d* may be selectively removed in a non-destructive manner when desired.

As shown in the figure, each opening 400 is countersunk so that the fastener 402 does not protrude above the surface of the beam 12. In other embodiments, each opening 400 may not be countersunk, and the fastener 402 may protrude above the surface of the beam 12.

Although the end 202 of beam 12*a* is illustrated as having two openings 400 for accommodating two fasteners 402, in other embodiments, the end of the beam 12 may have only one opening 400 for accommodating one fastener 402, or more than two openings 400 for accommodating more than two fasteners 402.

It should be noted that the beams 12*b*-12*d* are coupled to the respective plate portions at the connector 14 in the same manner as the beam 12*a* discussed herein. Also, any of the beams 12*b*-12*d* may have the same configuration as any of the embodiments of beam 12*a* described herein.

Figure 5:
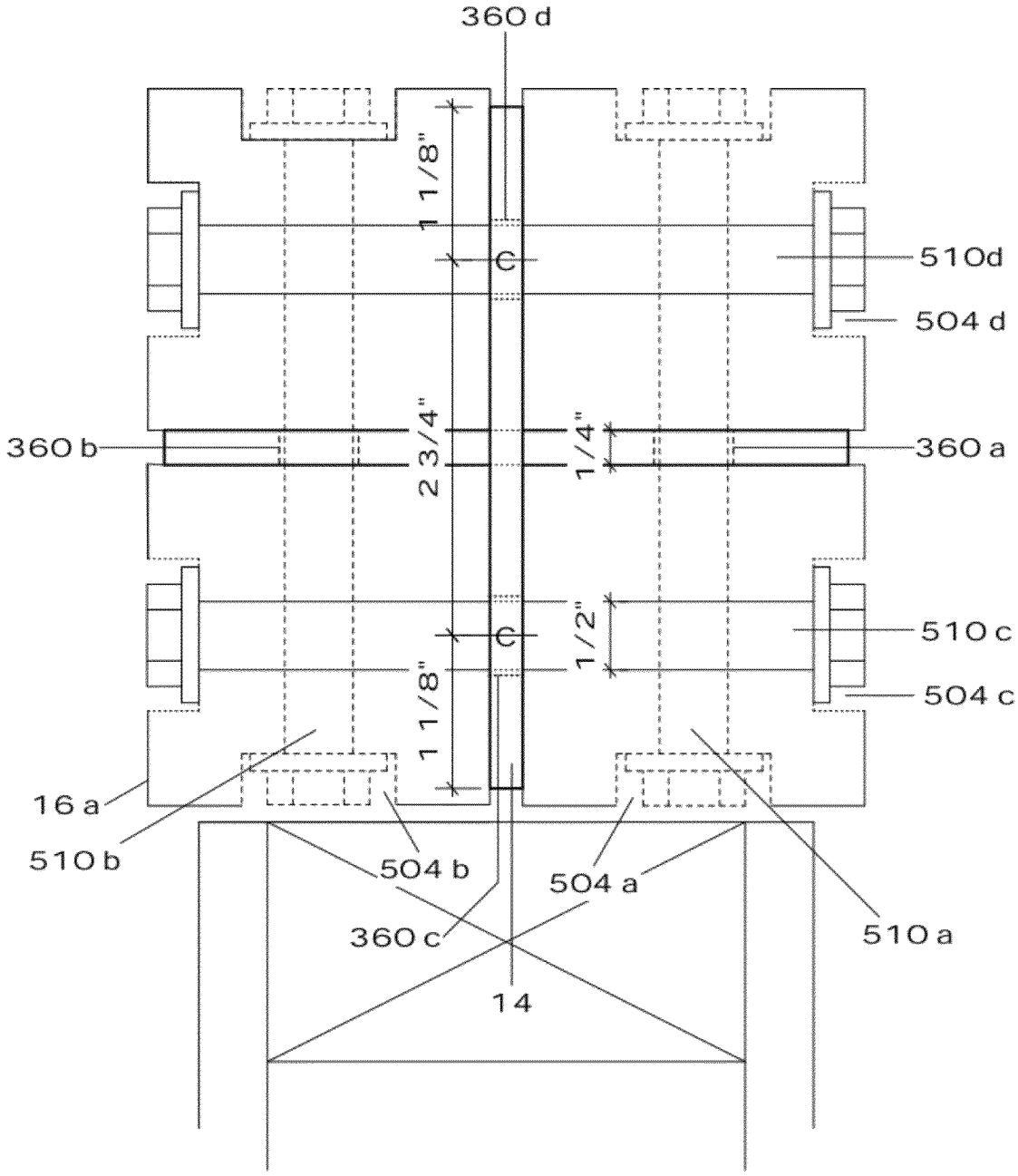
FIG. 5 illustrates another cross sectional view of the connector of FIG. 1 in accordance with some embodiments.

Returning back to FIG. 1, the column 16*a* includes an opening 500 at one end 502 of the column 16*a*, wherein the opening 500 has a size and shape that correspond with the cross sectional shape of the connector 14. The column 16*a* also includes openings 504*a*-504*d* for accommodating fasteners 510*a*-510*d*, respectively. During use, the lower end of the connector 14 may be placed inside the opening 500, and the fasteners 510*a*-510*d* may be used to detachably couple the column 16*a* to the connector 14. The connector 14 has openings 360*a*-360*d* (FIG. 3) for receiving the respective fasteners 510*a*-510*d* that have been inserted through the respective openings 504*a*-504*d* at the column 16*a*. FIG. 5 illustrates a cross section of the connector 14 at the location where the column 16*a* is coupled to the connector 14. As shown in the figure, each fastener 510 extends through the column 16*a* from one side and exits at another side. A nut is placed at the exit end of the fastener 510 to anchor the fastener 510 so that the fastener 510 is prevented from sliding off the column 16*a*. In some embodiments, each fastener 510 may be a bolt, a screw, or another type of connection device.

As shown in the figure, each opening 504 at the column 16 is countersunk so that the fastener 510 does not protrude above the surface of the column 16. In other embodiments, each opening 504 may not be countersunk, and the fastener 510 may protrude above the surface of the column 16.

Referring again to FIGS. 1 and 3, the connector 14 also includes four openings 360*e*-360*h* at the top end of the connector 14 for allowing the top column 16*b* to detachably couple to the connector 14 in a similar manner as that of column 16*a*.

In the illustrated embodiments of FIG. 3, the openings 420*a*-420*h* at the middle portion of the connector 14 for connection to the beams 12*a*-12*d* have the same spacing 480 (e.g., ¾ inch) from the side edge of the connector 14. Such configuration is advantageous because it allows any of the beams 12*a*-12*d* to interchangeably be coupled to different sides of the connector 14. In other embodiments, the spacing may be different from the example shown. For example, in other embodiments, the spacing may be more than ¾ inch or less than ¾ in.

Also, the openings 360*a*-360*d* at the bottom end of the connector 14 for connection to the column 16*a*, and the openings 360*e*-360*h* at the top end of the connector 14 for connection to the column 16*b*, have the same spacing 482 (e.g., 2 inches) from the side edge of the connector 14. Thus, the spacing 482 for the column attachment is different from the spacing 480 for the beam attachment. Such configuration is advantageous because it will prevent any of the beams 12 from being accidentally installed at the bottom end or the top end of the connector 14. In other embodiments, the spacing 482 may be the same as the spacing 480. Also, in other embodiments, the spacing 482 may be less than 2 inches or more than 2 inches.

Furthermore, as shown in FIGS. 1 and 3, the openings 360*a*, 360*b* at the first plate 300 are located at different elevation from the openings 360*c*, 360*d* at the second plate 302. Also, the first plate 300 does not have any openings that are at the same elevation as the openings 360*c*, 360*d* at the second plate 302, and the second plate 302 does not have any openings that are at the same elevation as the openings 360*a*, 360*b* at the first plate 300. Such configuration is advantageous because it allows the two fasteners 510*a*, 510*b* to couple the column 16 to the connector 14 without interfering with the fasteners 510*c*, 510*d*. Such configuration is also advantageous in that it reduces the number of openings at the column 16 that are required to be made (i.e., when compared to the configuration that has eight openings with four openings at the elevation of opening 360*a*, and the other four openings at the elevation of opening 360*c*) in order to secure the column 16 to the connector 14. This in turn prevents the column 16 strength from being weakened too much due to high number of openings made at the column 16.

It should be noted that the configuration of the connector 14 is not limited to the example shown, and that the connector 14 may have different configurations in different embodiments. For example, in other embodiments, the number of openings 420 for connection to a beam 12 at each side of the connector 14 may be less than two (e.g., one), or more than two. Also, in other embodiments, the number of openings 360 for connection to a column 16 at each side of the connector 14 may be more than one. In addition, in other embodiments, the spacing for the opening(s) 420 from the side edge of the connector 14 may be the same as that for the opening(s) 360 from the side edge of the connector 14. In further embodiments, the slot 310 at the first plate 300 may be extended from the top edge 313 (instead of the bottom edge 312), and the slot 320 at the second plate 322 may be extended from the bottom edge 323 (instead of the top edge 322). In still further embodiments, the lengths of the slots 310, 320 may be different.

Figure 6A:
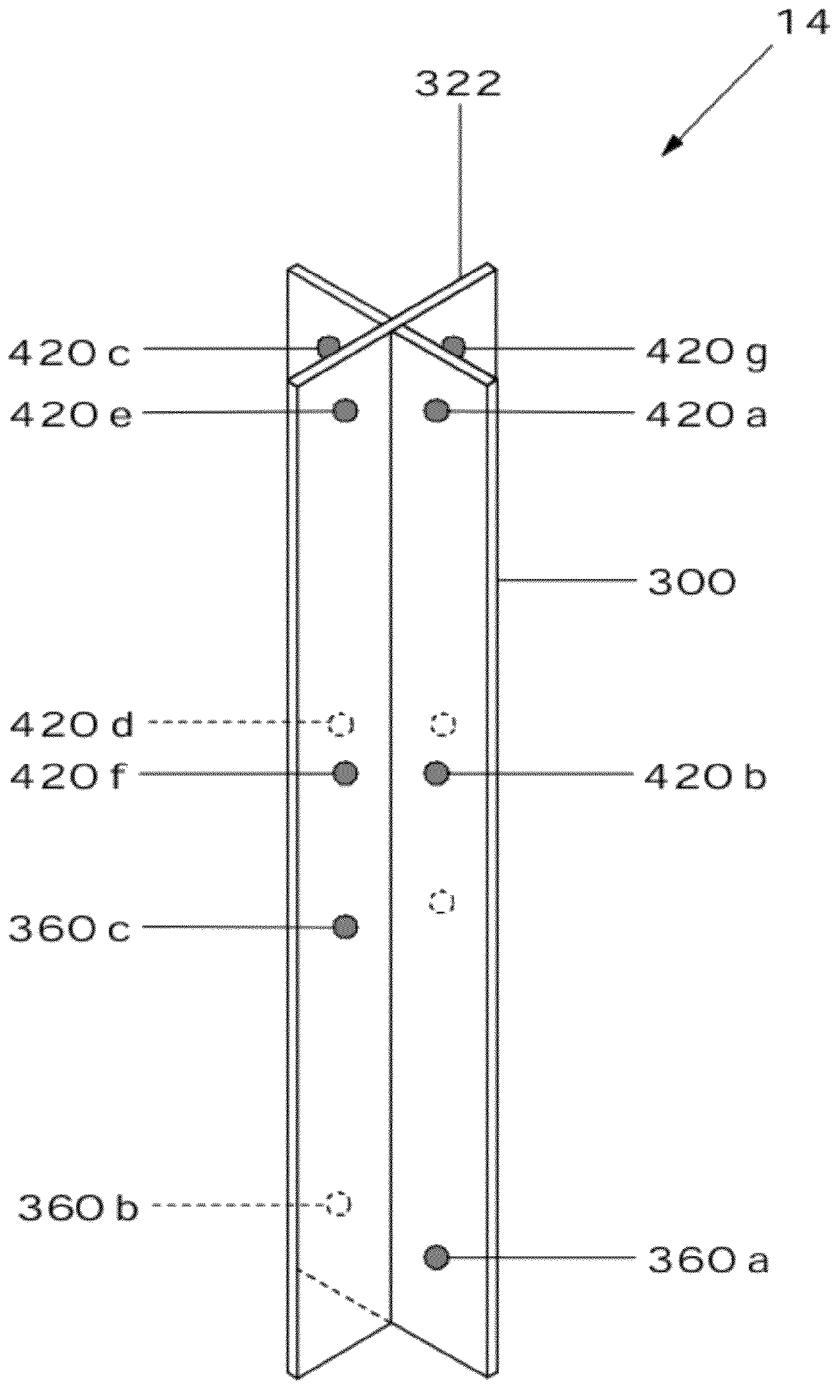
FIGS. 6A and 6B illustrate another connector in accordance with other embodiments.
Figure 6B:
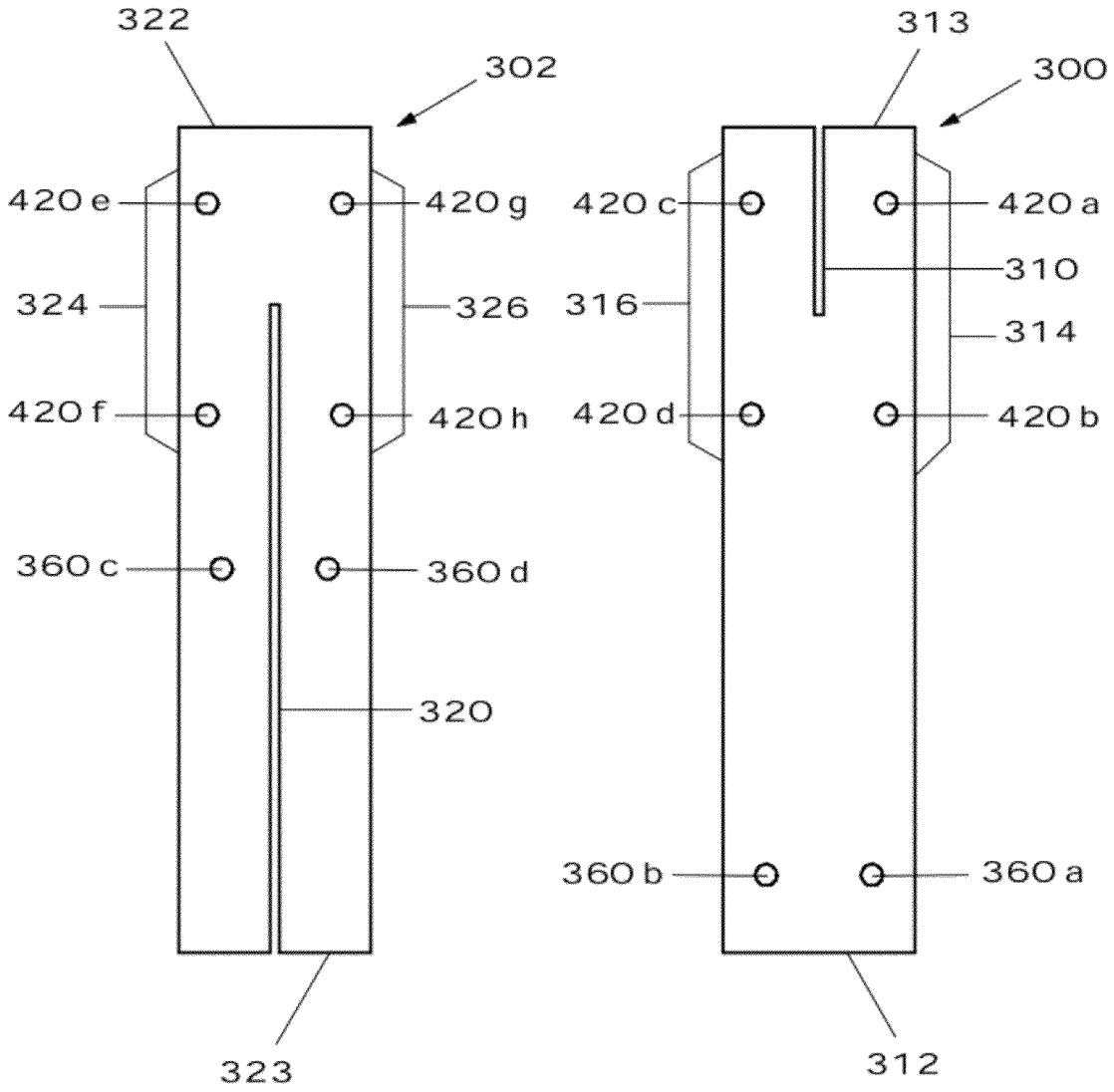

In the above embodiments, the connector 14 is configured to allow two columns 16 to be detachably coupled to the top and bottom ends of the connector 14. In other embodiments, the connector 14 may be configured to allow one column 16 to be detachably coupled to the bottom end of the connector 14. In such cases, the connector 14 may not include the top portion that is for detachably coupling to the column 16*b*. FIG. 6A shows the connector 14 that is the same as the embodiments of FIG. 1, except that the connector 14 does not have any part for allowing a top column 16 to be detachably coupled thereto. As shown in the illustrated embodiments, the connector 14 has a cross shape cross section, with four plate portions 314, 316, 324, 326. The four plate portions 314, 316, 324, 326 allow up to four beams 12 to be detachably coupled thereto. However, in other embodiments, there may be one, two, or three beams 12 connected to the connector 14. FIG. 6B illustrates components of the connector 14 of FIG. 6A. The embodiment of the connector 14 of FIG. 6 may be used to connect beams 12 at the roof level, or at other location where there is no top column 16.

Figure 7A:
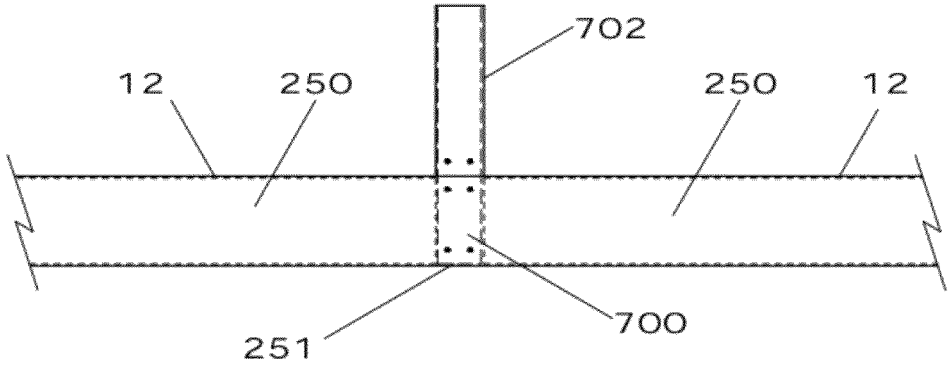
FIG. 7A illustrates a column being detachably coupled to a beam in accordance with some embodiments.
Figure 7B:
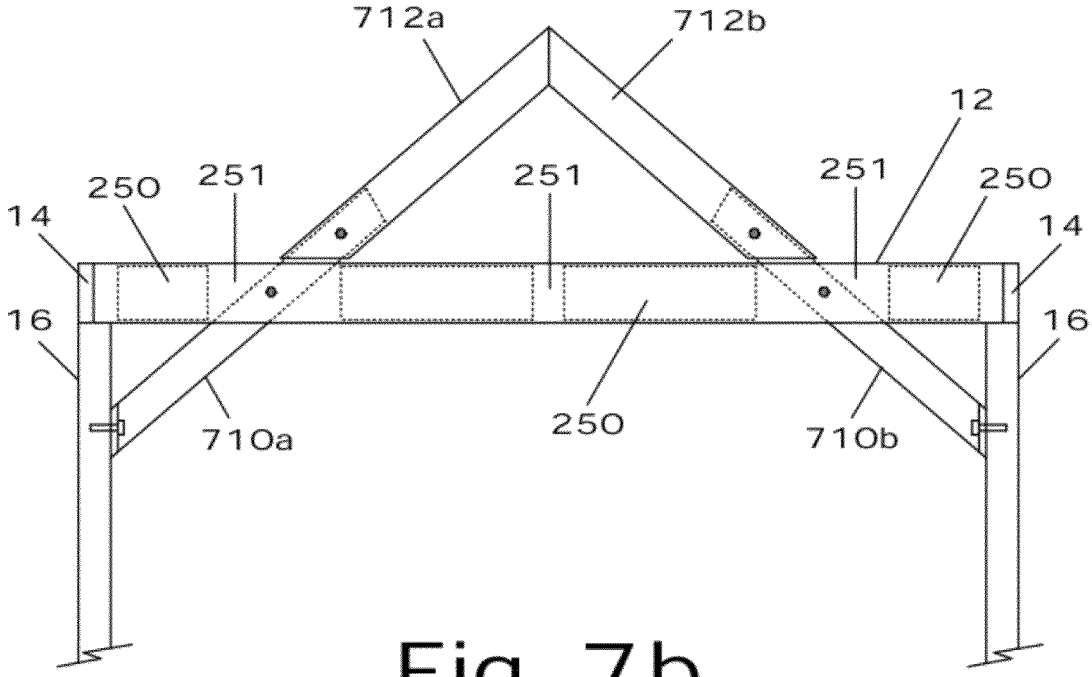
FIG. 7B illustrates a truss system being detachably coupled to a beam in accordance with some embodiments.

As discussed, in some embodiments, the beam 12 may include one or more plates 250 between beam portions 202, 204 (FIG. 2A). In some cases, the plates 250 may be spaced along the length of the beam 12 so that they define one or more spacing 251 between them (FIG. 7A). Such configuration allows another building component 700 to be inserted into the spacing 251 between the adjacent plates 250 that are sandwiched between beam portions 202, 204. In the illustrated embodiments, the component 700 is a connector plate for connecting a column 702 to a part of the beam 12 that is away from the ends of the beam 12. In other embodiments, the spacing 251 between the beam portions 202, 204 may optionally allow truss connectors 710*a*, 710*b* to be inserted therethrough, wherein each of the truss connectors 710*a*, 710*b* is coupled to a column 16 at one end, and to a truss member 712*a*/712*b* at the other end (FIG. 7B). In further embodiments, the spacing 251 between the beam portions 202, 204 may allow other building component(s) (e.g., structural member(s), or architectural member(s) such as a panel, a window, a door, a flooring, etc.), to be coupled to the beam 12.

Figure 8:
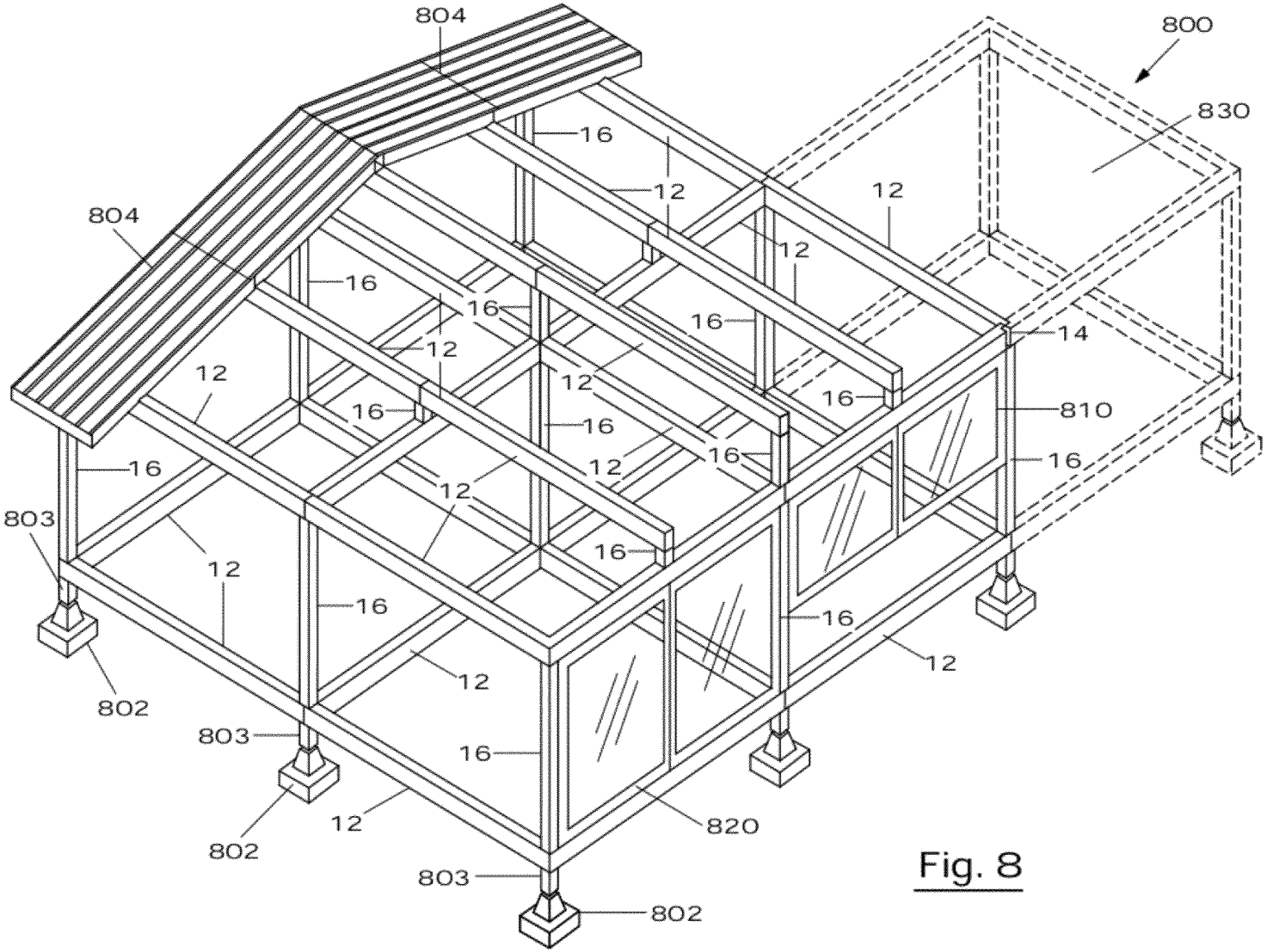
FIG. 8 illustrates a building structure constructed using a building system in accordance with some embodiments.

FIG. 8 illustrates a building structure 800 that is constructed using the building system 10 of FIG. 1 in accordance with some embodiments. As shown in the figure, the beams 12, columns 16, and connectors 14 are used to construct the frame for the building structure 800. The building system 10 further includes foundation 802, and foundation posts 803. Each foundation 802 may include a concrete footing with a metal connector for allowing the foundation post 803 to detachably couple thereto. Each foundation post 803 includes a top end for detachably couple to a bottom end of the connector 14.

As shown in the illustrated embodiments, the building structure 800 further includes roof panels 804, window frame(s) 810, and wall panel(s) 820. The wall panel 820 is illustrated as having two large window openings. In other embodiments, the wall panel 820 may have one window opening, or no window opening. Also, in further embodiments, the wall panel 820 may be secured to the outside face of the beams 12 and columns 16 so that the wall panel 820 may be used to completely cover up the framing formed by the beams 12 and columns 16. The roof panels 804 are configured to detachably couple to the beams 12 of the building structure 800. Also, the window frame(s) 810 and the wall panel(s) 820 are configured to detachably couple to the frame formed by the beams 12 and columns 16 of the building structure 800. In further embodiments, the building system 10 may further includes other building components (such as interior wall panels, floor panels, ceiling panels, etc.) that are configured to detachably couple to the framing formed by the beams 12 and columns 16. The detachably coupling of the components (e.g., components 802, 803, 804, 810, 820, interior wall panels, floor panels, ceiling panels, etc.) to the building structure 800 may be accomplished using fasteners, such as screws, bolts, clips, or other types of connection devices.

As illustrated in the above embodiments, the building system 10 is advantageous because it allows the building structure 800 to be designed and constructed efficiently and cost effectively. Because the building structure 800 can be assembled easily using the building system 10, the design and construction of the building structure 800 may not require multiple professionals to get involved, and an owner of the building may design and construct the building structure 800 himself/herself. Also, the building system 10 is advantageous because it allows any of the components (e.g., beam(s) 12, connector(s) 14, column(s) 16, post(s) 803, panel(s) 804, window frame(s) 810, wall panel(s) 820, interior wall panel(s), floor panel(s), ceiling panel(s), etc.) of the building to be conveniently removed in a non-destructive manner from the rest of the building when desired. If example, if a user of the system 10 wishes to change the configuration of the building, the user may selectively remove some of the components from the building, and re-use at least some of the components to form a different configuration for the building 800. Also, in some cases, the entire building 800 made from the building system 10 may be disassembled at one location, and be reassembled in a different location. Furthermore, if a user of the building system 10 wishes to expand a building (such as adding a room 830, as represented by the dashed line in the figure), the user may obtain additional components (e.g., beam(s), connector(s) 14, column(s) 16, etc.), and add those to the already formed building 800. Thus, embodiments of the building system 10 allow scalability of the building to be accomplished in a cost effective and efficient manner. In other cases, the building 800 formed using the building system 10 may also be scaled down (downsized) by removing some of the components in a non-destructive manner.

Also, as illustrated in the above embodiments, the building system 10 is advantageous because it allows an owner of the building to selectively change the configuration at any time (e.g., before, during, and/or after the construction of the building). Because the owner can himself/herself decide how the configuration of the building is to be changed, purchase the building components, and assemble the building components himself/herself, the changing of the configuration of the building does not require multiple professionals to get involved. This in turn, allows the configuration of the building to be changed in a cost effective and efficient manner.

It should be noted that the various dimensions shown in some of the figures are exemplary dimensions, and that in other embodiments, the components may have different sizes from that illustrated in the figures.

Also, it should be noted that the term "first" (as in "first plate portion", "first beam", "first opening", for examples), and the term "second" (as in "second plate portion", "second beam", "second opening", for examples), are used to refer to different things, and do not necessarily refer to the order of things.

Although particular embodiments have been shown and described, it will be understood that they are not intended to limit the present inventions, and it will be obvious to those skilled in the art that various changes and modifications may be made without departing from the spirit and scope of the present inventions. The specification and drawings are, accordingly, to be regarded in an illustrative rather than restrictive sense. The present inventions are intended to cover alternatives, modifications, and equivalents, which may be included within the spirit and scope of the present inventions as defined by the claims.

What is claimed:

1. A building system, comprising:

a connector having:

a first plate having a first opening for connection to a first beam and a second opening for connection to a first column; and a second plate having a third opening for connection to a second beam and a fourth opening for connection to the first column;

wherein the first plate is oriented relative to the second plate at 90°, and the first plate and the second plate collectively form a "+" cross sectional shape;

wherein the first opening at the first plate and the third opening at the second plate are located at a first elevation with respect to the connector;

wherein the second opening at the first plate is located at a second elevation with respect to the connector;

wherein the fourth opening at the second plate is located at a third elevation with respect to the connector;

wherein the second plate does not include any opening at the second elevation;

wherein the first plate has a first surface that faces towards the first beam when the first beam is connected to the connector, and a second surface that faces towards the second beam when the second beam is connected to the connector, the second surface being opposite from the first surface; and wherein the first plate has a first edge at the second elevation and a second edge at the second elevation that define a width of the first plate at the second elevation, and wherein the first opening at the first elevation is located within an area of the first plate that is confined by a vertical extension of the first edge and a vertical extension of the second edge.

2. The system of claim 1, further comprising the first beam, wherein the first beam has a first end, a second end, and a longitudinal axis extending between the first end and the second end, wherein the first beam further includes an opening located between the first end and the second end, the opening extending from a top surface of the first beam into a body of the first beam, wherein the opening is sized and shaped to receive a plate of an additional connector and has a cross sectional dimension that is larger than a width of the plate;

wherein the first end is offset relative to the longitudinal axis in a first direction; and wherein the second end is offset relative to the longitudinal axis in a second direction that is opposite of the first direction.

3. The system of claim 1, further comprising the additional connector;

wherein the plate of the connector has an opening at the plate for receiving a fastener extending through a hole at a side of the first beam; and wherein the connector further includes a top portion configured for coupling to a column.

4. The system of claim 1, further comprising the first column, the first column having a column end, wherein the column end has an opening for accommodating a portion of the connector.

5. The system of claim 4, wherein the opening of the column end is configured to accommodate the "+" cross-sectional shape of the connector.

6. The system of claim 1, wherein the first beam has a configuration for allowing the first beam to be removed non-destructively from the connector after the first beam is mounted to the connector.

7. The system of claim 1, wherein:

the first plate has a first slot extending from a side of the first plate;

the second plate has a second slot extending from a side of the second plate; and the first plate and the second plate are coupled to each other through the respective first and second slots.

8. The system of claim 1, further comprising:

the first beam with a first end configured for detachably coupling to the first plate; and the second beam with a second end configured for detachably coupling to the second plate.

9. The system of claim 1, wherein the first opening at the first plate has an axis extending therethrough that forms an acute angle relative to the first plate.

10. The system of claim 1, wherein the first plate and the second plate are coupled to each other without using any weld and fastener.

11. The system of claim 1, further comprising the first beam, wherein the first beam includes a side opening extending from a side wall of the beam into the body of the beam, the side opening configured to receive a fastener with an axis that forms an acute angle relative to a longitudinal axis of the first beam.

12. The system of claim 1, wherein the first opening is located at a top end of the first plate, and the third opening is located at a top end of the second plate.

13. The system of claim 1, wherein the first plate does not include any opening at the third elevation.

14. The system of claim 1, further comprising the first beam, wherein the first beam has a first end, a second end, and a longitudinal axis extending between the first end and the second end;

wherein the first beam includes a first beam portion with the first end and a second beam portion with the second end, the first beam portion having a first beam body that extends along the longitudinal axis, the second beam portion having a second beam body that extends along the longitudinal axis;

wherein the first beam portion directly abuts the second beam portion, and is detachably secured to the second beam portion;

wherein the first end is offset relative to the longitudinal axis in a first direction; and wherein the second end is offset relative to the longitudinal axis in a second direction that is opposite of the first direction.

15. The system of claim 1, further comprising the first beam, wherein the first beam includes a first beam portion and a second beam portion, the first beam portion includes one or more side holes, the second beam portion includes one or more side holes that are aligned with the one or more side holes at the first beam portion, and the first beam further includes one or more fasteners for detachably coupling the first beam portion against the second beam portion.

16. The system of claim 1, further comprising the first beam, wherein the first beam comprises a first portion and a second portion that is coupled directly or indirectly relative to the first portion.

17. The system of claim 16, further comprising a plate coupled between the first beam portion and the second beam portion.

18. The system of claim 16, wherein the first beam has a first end, and wherein the first end of the first beam comprises a hole for accommodating a fastener, wherein the hole has an axis extending therethrough that forms an acute angle relative to the longitudinal axis of the first beam.

19. The system of claim 1, further comprising the first beam with a beam body, wherein the beam body has a unity configuration.

20. The system of claim 1, wherein the first plate and the second plate are welded to each other.

21. The system of claim 1, wherein the first plate has an additional opening for connection to a third beam, and the second plate has an additional opening for connection to a fourth beam.

22. The system of claim 21, further comprising the first beam, the second beam, the third beam, and the fourth beam, the first beam having a first end, the second beam having a second end, the third beam having a third end, and the fourth beam having a fourth end, and wherein the first end of the first beam, the second end of the second beam, the third end of the third beam, and the fourth end of the fourth beam collectively conceal the connector circumferentially around a segment of the connector when the first beam, the second beam, the third beam, and the fourth beam are connected to the connector.

23. The system of claim 1, wherein the first plate has an additional opening for connection to a second column, and the second plate has an additional opening for connection to the second column.

24. The system of claim 1, further comprising the first column, the first column having an end configured to circumferentially conceal a segment of the connector when the first column is connected to the connector.

25. The system of claim 1, wherein the first plate has a first edge at the second elevation and a second edge at the second elevation that define a width of the first plate at the second elevation, and wherein the first edge extends vertically past the first elevation.

26. The system of claim 1, further comprising one or more connectors for connecting a first end of the first beam to the connector, wherein the one or more connectors are configured to provide a complete vertical support for the first end of the first beam.

27. The system of claim 1, further comprising the first beam, wherein the first beam is configured to be non-destructively removed from the connector.

* * * * *